US009395733B2

(12) United States Patent
Yang

(10) Patent No.: US 9,395,733 B2
(45) Date of Patent: Jul. 19, 2016

(54) VOLTAGE ADJUSTING CIRCUIT APPLIED TO REFERENCE CIRCUIT

(71) Applicant: Macronix International Co., Ltd., Hsin-chu (TW)

(72) Inventor: Yih-Shan Yang, Hsinchu (TW)

(73) Assignee: MACRONIX International Co., Ltd., Hsinchu (TW)

( * ) Notice: Subject to any disclaimer, the term of this patent is extended or adjusted under 35 U.S.C. 154(b) by 242 days.

(21) Appl. No.: 13/975,155

(22) Filed: Aug. 23, 2013

(65) Prior Publication Data

US 2015/0054476 A1 Feb. 26, 2015

(51) Int. Cl.
*G05F 1/625* (2006.01)
*G05F 1/565* (2006.01)

(52) U.S. Cl.
CPC ..... *G05F 1/625* (2013.01); *G05F 1/565* (2013.01)

(58) Field of Classification Search
CPC ..... G05F 1/10; G05F 1/625
USPC ..... 323/313–316
See application file for complete search history.

(56) References Cited

U.S. PATENT DOCUMENTS 4,761,765 A * 8/1988 Hashimoto ..... 365/185.21
6,630,858 B1 * 10/2003 Takabayashi ..... 327/538
7,126,413 B2 * 10/2006 Filoramo et al. ..... 330/2
2002/0008500 A1 * 1/2002 Hashimoto ..... 323/280
2005/0116761 A1 * 6/2005 Pentakota et al. ..... 327/309
2005/0184805 A1 * 8/2005 Murakami ..... 330/261
2006/0017496 A1 * 1/2006 Yamada et al. ..... 327/540
2007/0053115 A1 * 3/2007 Tain et al. ..... 361/18
2008/0018318 A1 * 1/2008 Hsu ..... 323/315
2010/0079121 A1 * 4/2010 Yanagawa ..... 323/277
2010/0296210 A1 * 11/2010 Ball et al. ..... 361/56
2011/0031918 A1 * 2/2011 Sugie ..... 318/400.29
2011/0062996 A1 * 3/2011 Chang et al. ..... 327/77
2011/0095745 A1 * 4/2011 Noda ..... 323/315
2011/0156822 A1 * 6/2011 Takano et al. ..... 331/57
2012/0081092 A1 * 4/2012 Pavlin et al. ..... 323/282
2013/0293986 A1 * 11/2013 Lerner et al. ..... 361/18
2014/0021979 A1 * 1/2014 Huang ..... 324/762.09
2014/0084994 A1 * 3/2014 Merkin et al. ..... 327/543
2015/0008965 A1 * 1/2015 Jaffari ..... 327/109

* cited by examiner

*Primary Examiner* — Timothy J Dole
*Assistant Examiner* — Yusef Ahmed
(74) *Attorney, Agent, or Firm* — J.C. Patents

(57) ABSTRACT

A circuit includes a detection node and a feedback node adapted to communicate with a reference circuit. A clamping transistor includes current conducting terminals and a gate coupled to the detection node. An amplifier transistor includes current conducting terminals in series with the current conducting terminals of the clamping transistor and a gate coupled to the detection node. The amplifier transistor is configured to cause a second voltage to be provided to the feedback node in response to the clamping transistor receiving a first voltage from the detection node.

13 Claims, 6 Drawing Sheets

Figure 1A – Prior Art
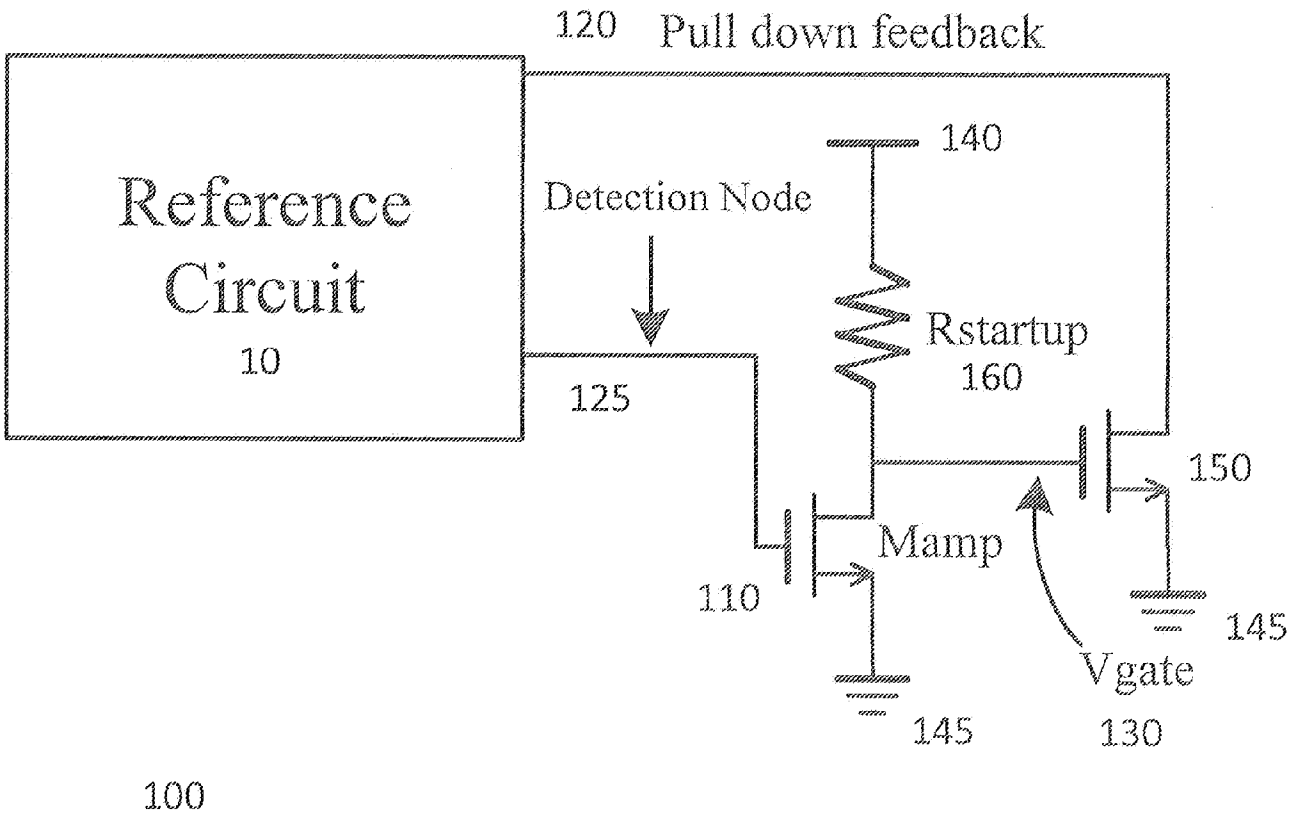

Figure 1B – Prior Art
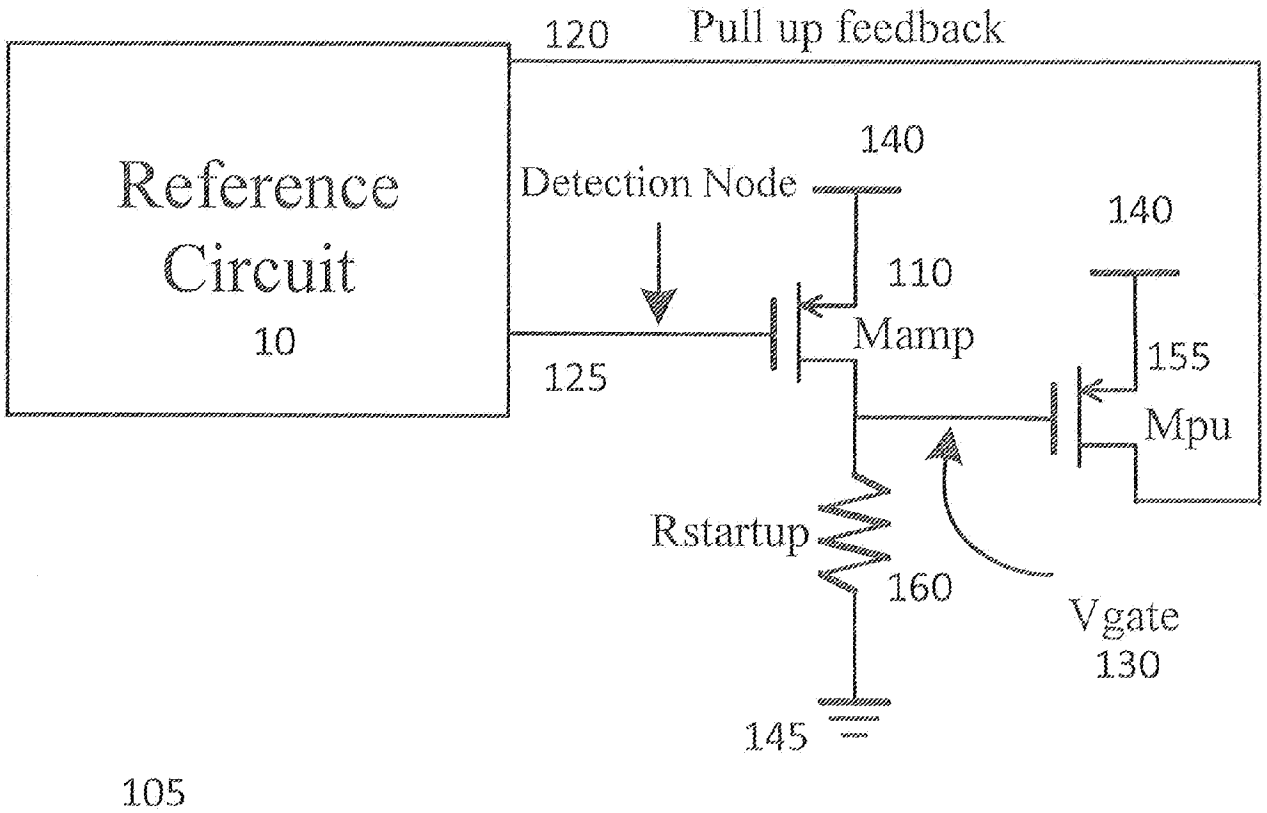

VOLTAGE ADJUSTING CIRCUIT APPLIED TO REFERENCE CIRCUIT

BACKGROUND

Reference circuits may be used in a variety of applications to provide known reference values, such as reference voltages or currents. For example, a bandgap voltage reference circuit may provide a temperature independent voltage reference for use with other circuits such as flash memory circuits, other memory circuits, and/or other integrated circuits. Reference circuits may include voltage adjusting circuits, for example startup circuits. A voltage adjusting circuit may initialize one or more inputs of another circuit by forcing a voltage on a node or a current into a branch, for example. This may allow the circuit connected to the voltage adjusting circuit to quickly begin operation in a proper initial state. For example, in the voltage adjusting circuits described herein, a reference voltage may be applied to a feedback node by a voltage adjusting circuit when a voltage at a detection node is not a desired voltage.

It may be desirable to design voltage reference circuits with low current consumption so that their presence does not adversely affect operation of an associated circuit. Voltage adjusting circuits described herein may enable the creation of cost efficient, low current consumption reference circuits.

FIGS. 1A and 1B are prior art voltage adjusting circuits 100, 105. Voltage adjusting circuit 100 of FIG. 1A is a pull down type voltage adjusting circuit, and voltage adjusting circuit 105 of FIG. 1B is a pull up type voltage adjusting circuit. The voltage adjusting circuits 100, 105 may communicate with a reference circuit 10 at a feedback node 120 and a detection node 125. The reference circuit 10 may be any circuit having an operation which can be improved by a voltage adjusting circuit such as a startup circuit. Examples include the reference circuits disclosed in H. Banba, et al., "A CMOS Band Gap Reference Circuit With Sub-1-V Operation," IEEE Journal of Solid-State Circuits, Vol. 34, No. 5, May 1999, pp. 670-674, the contents of which are incorporated herein by reference in their entirety. The detection node 125 may represent the output of the reference circuit 10 and the feedback node 120 may represent the input to an element controlling the output of the reference circuit.

The pull down voltage adjusting circuit 100 of FIG. 1A may include a resistive load common source amplifier Mamp 110, for example a transistor with its source connected to ground 145 and its drain connected to a node Vgate 130. A resistor 160, having a value of Rstartup, may be connected between a voltage source Vdd 140 and Vgate 130. The gate of the amplifier Mamp 110 may be connected to the detection node 125. A pull down transistor 150 may have its drain connected to the feedback node 120, its gate connected to Vgate 130, and its source connected to ground 145. The amplifier Mamp 110 may drive the pull down transistor 150 to pull the feedback node 120 out of an undesirable metastable or unstable operation of reference circuit 10 when the feedback node 120 is not at the desired voltage. Thus, the detection node 125 indicates two stable states of the reference circuit 10, an active state and a non-active state. When the detection node indicates a non-active state, the voltage adjusting circuit 100 applies a voltage to the feedback node 120 to cause the reference circuit 10 to enter the active state.

Similarly, the pull up voltage adjusting circuit 105 of FIG. 1B may include a resistive load common source amplifier Mamp 110, for example a transistor with its drain connected to a node Vgate 130 and its source connected to a voltage source Vdd 140. A resistor 160, having a value of Rstartup, may be connected between Vgate 130 and ground 145. The gate of the amplifier Mamp 110 may be connected to the detection node 125. A pull up transistor 155 may have its source connected to the voltage source 140, its gate connected to Vgate 130, and its drain connected to the feedback node 120. The amplifier Mamp 110 may drive the pull up transistor 150 to pull the feedback node 120 to a desired reference voltage when the feedback node 120 is not at the desired voltage.

The current consumption of the prior art voltage adjusting circuit examples 100, 105 may be approximated by Vdd/Rstartup, because an equivalent resistance of Mamp 110 may be substantially smaller than the resistance Rstartup of resistor 160. In order to keep the current consumption small, the value Rstartup of resistor 160 may be high. Thus, these circuits 100, 105 may use expensive resistors with high resistance values and/or large resistor arrays. For example, in a case wherein Vdd is 3V, and the desired standby current for the voltage adjusting circuit is 1 μA or less, a 3 MΩ resistor may be used.

The circuits of FIGS. 1A and 1B may be employed as startup circuits.

SUMMARY OF THE DISCLOSURE

A circuit comprises a detection node and a feedback node adapted to communicate with a reference circuit. A clamping transistor comprises current conducting terminals and a gate coupled to the detection node. An amplifier transistor comprises current conducting terminals in series with the current conducting terminals of the clamping transistor and a gate coupled to the detection node. The amplifier transistor is configured to cause a second voltage to be provided to the feedback node in response to the clamping transistor receiving a first voltage from the detection node.

BRIEF DESCRIPTION OF THE DRAWINGS

FIG. 1A is a prior art pull down voltage adjusting circuit.

FIG. 1B is a prior art pull up voltage adjusting circuit.

DETAILED DESCRIPTION OF SEVERAL EMBODIMENTS

Figure 2A:
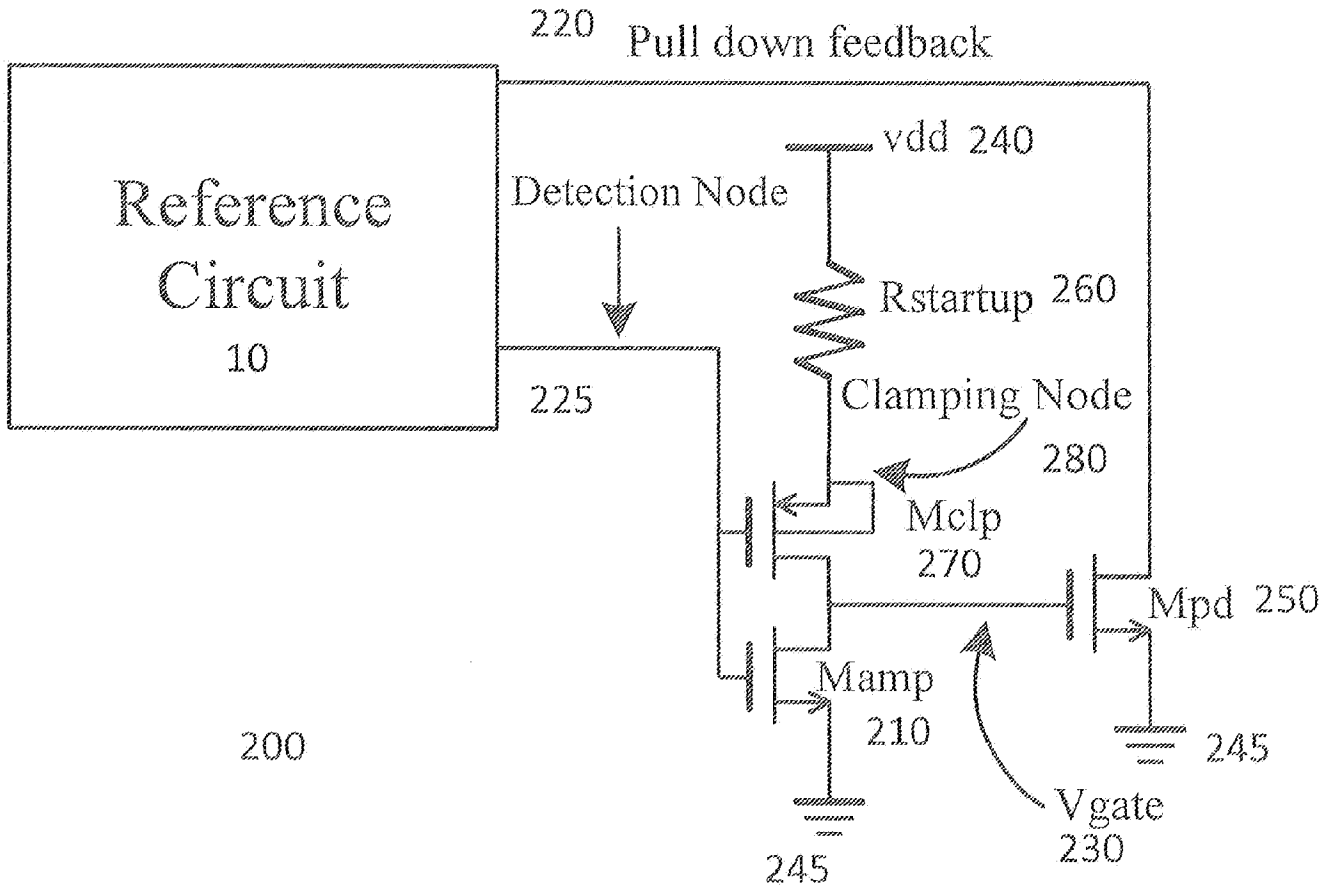
FIG. 2A is a pull down voltage adjusting circuit according to an embodiment of the invention.
Figure 2B:
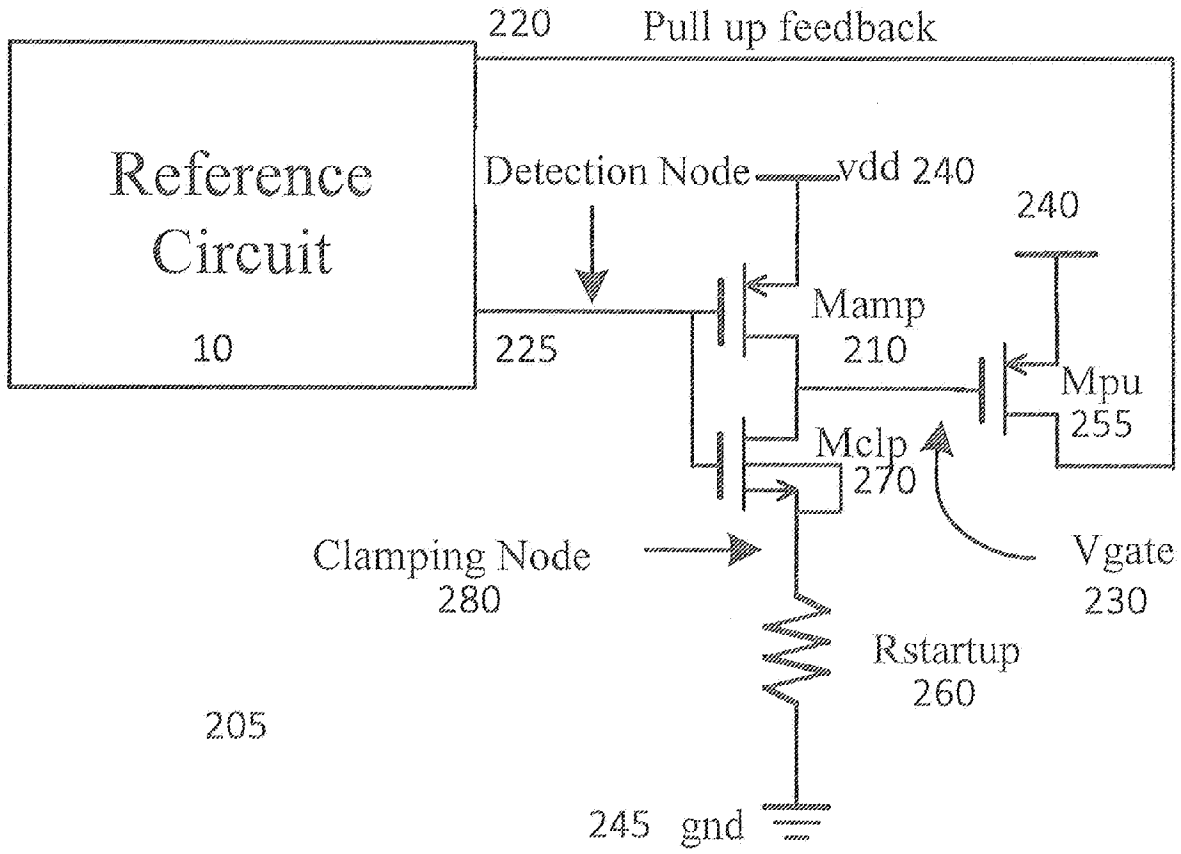
FIG. 2B is a pull up voltage adjusting circuit according to an embodiment of the invention.

FIGS. 2A and 2B illustrate embodiments wherein a clamping transistor is incorporated into a voltage adjusting circuit to improve current consumption. FIG. 2A is a pull down voltage adjusting circuit 200 according to an embodiment of the invention. The voltage adjusting circuit 200 may communicate with a reference circuit 10 at a feedback node 220 and a detection node 225. The circuit 200 may include several transistors, each of which may have a gate and a plurality of current conducting terminals (e.g., a source and drain in the case of a FET or an emitter and collector in the case of a BJT). The pull down voltage adjusting circuit 200 may include an amplifier element, such as a resistive load common source amplifier Mamp 210, for example a transistor with its source connected to ground 245, its output or drain connected to a node Vgate 230, and its input or gate connected to the detection node 225. A pulling element, such as pull down transistor 250 may have its drain connected to the feedback node 220, its gate connected to Vgate 230, and its source connected to ground 245. The voltage adjusting circuit 200 may include a load, such as resistor Rstartup 260 and a clamping element, such as clamping transistor Mclp 270. The resistor Rstartup 260 may be connected between a voltage source Vdd 240 and a clamping node 280. The source of the clamping transistor Mclp 270 may be connected to the clamping node 280. the gate may be connected to the detection node 225, and the drain may be connected to Vgate 230. The clamping transistor Mclp 270 may force a voltage at the clamping node 280 (Vclp) to be a sum of a voltage at the detection node 225 (Vdet) and a threshold voltage of Mclp 270 (Vth). The amplifier Mamp 210 may drive the pull down transistor 250 to pull the feedback node 220 out of an undesired metastable or unstable operation point when the feedback node 220 is not at the desired voltage. When the detection node 225 of the voltage adjusting circuit 200 achieves a voltage indicating an active operation of voltage adjusting circuit 200, current may flow through the series connected clamping transistor 270 and amplifier 210. The current consumption for this circuit 200 may be (Vdd−Vclp)/Rstartup (i.e., (Vdd−Vdet−Vth)/Rstartup), For example, in a case wherein Vdd is 3V, Vdet is 1.3V, and Vth is 0.7V, a 1 MΩ resistor may be used to provide a desired standby current for the voltage adjusting circuit of 1 μA or less. Note that the transistors used in this circuit 200 are not limited to a specific transistor type. For example, the transistors shown are metal oxide semiconductor field effect transistors, but bipolar junction transistors could also be used. Also note that the circuit 200 may be assembled as a package or as part of another system wherein the voltage source and ground are not initially provided. In these cases, external nodes may be provided in place of the voltage source and ground described above, and these external nodes may be configured to be connected to a voltage source and ground.

FIG. 2B is a pull up voltage adjusting circuit 205 according to an embodiment of the invention. The voltage adjusting circuit 205 may communicate with a reference circuit 10 at a feedback node 220 and a detection node 225. The circuit 205 may include several transistors, each of which may have a gate and a plurality of current conducting terminals (e.g., a source and drain in the case of a FET or an emitter and collector in the case of a BJT). The pull up voltage adjusting circuit 205 may include an amplifier element, such as a resistive load common source amplifier Mamp 210, for example a transistor with its source connected to Vdd 240, its output or drain connected to a node Vgate 230, and its gate connected to the detection node 225. A pulling element, such as pull up transistor 255 may have its drain connected to the feedback node 220. its gate connected to Vgate 230, and its source connected to Vdd 240. The voltage adjusting circuit 205 may include a load, such as resistor Rstartup 260 and a clamping element, such as clamping transistor Mclp 270. The resistor Rstartup 260 may be connected between ground 245 and a clamping node 280. The source of the clamping transistor Mclp 270 may be connected to the clamping node 280, the gate may be connected to the detection node 225. and the drain may be connected to Vgate 230. The clamping transistor Mclp 270 may force a voltage at the clamping node 280 (Vclp) to be a difference of a voltage at the detection node 225 (Vdet) and a threshold voltage of Mclp 270 (Vth). The amplifier Mamp 210 may drive the pull up transistor 255 to pull the feedback node 220 out of an undesired metastable or unstable operation point when the feedback node 220 is not at the desired voltage, When the detection node 225 of the voltage adjusting circuit 200 achieves a voltage indicating an active operation of voltage adjusting circuit 200, current may flow through the series connected clamping transistor 270 and amplifier 210. The current consumption for this circuit 205 may be Vclp/Rstartup (i.e., (Vdet−Vth)/Rstartup). For example, in a case wherein Vdet is 1.7V and Vth is 0.7V, a 1 MΩ resistor may be used to provide a desired standby current for the voltage adjusting circuit of 1 μA or less. Note that the transistors used in this circuit 205 are not limited to a specific transistor type. For example, the transistors shown are metal oxide semiconductor field effect transistors, but bipolar junction transistors could also be used. Also note that the circuit 205 may be assembled as a package or as part of another system wherein the voltage source and ground are not initially provided. In these cases, external nodes may be provided in place of the voltage source and ground described above, and these external nodes may be configured to be connected to a voltage source and ground.

Figure 3A:
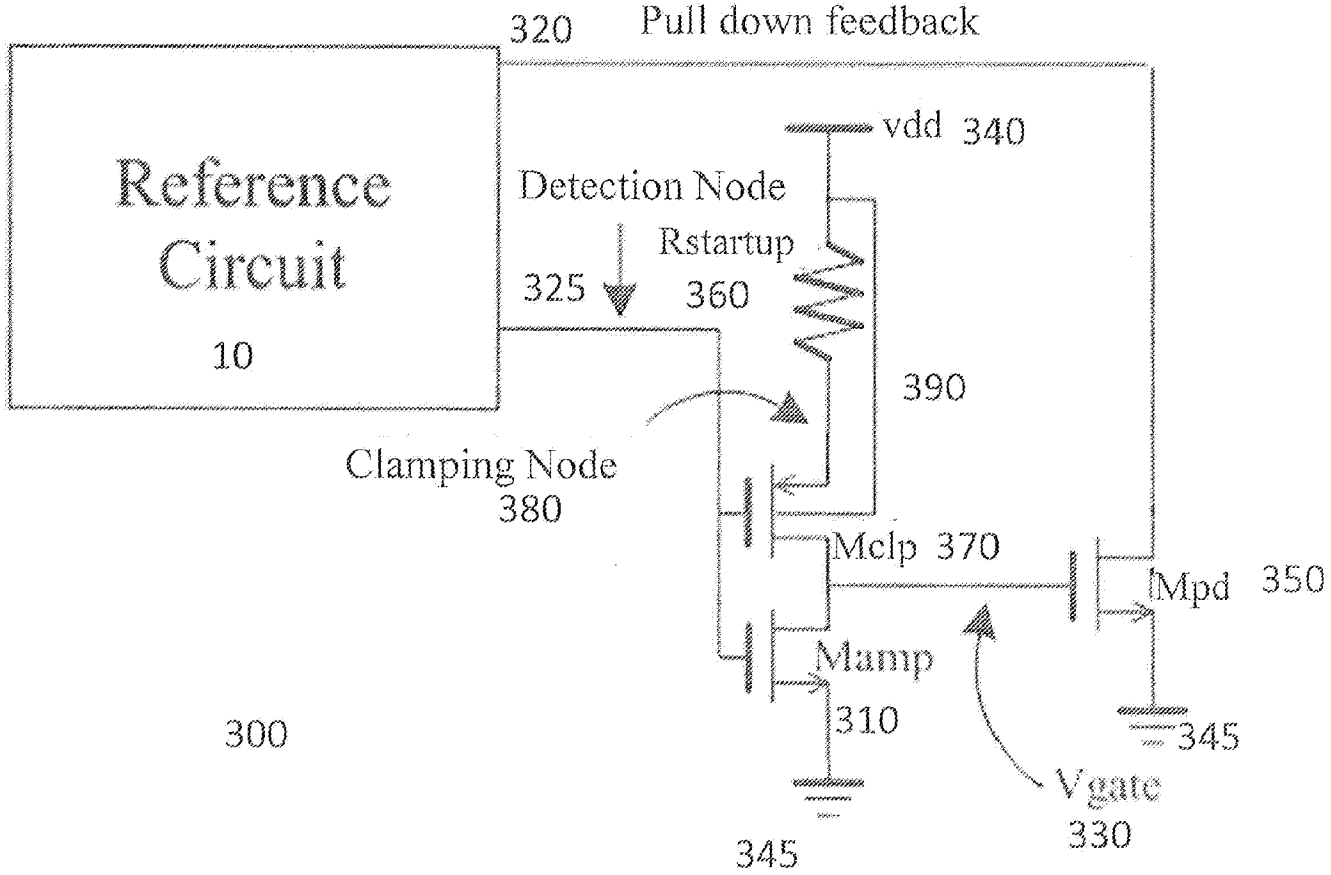
FIG. 3A is a body effect pull down voltage adjusting circuit according to an embodiment of the invention.
Figure 3B:
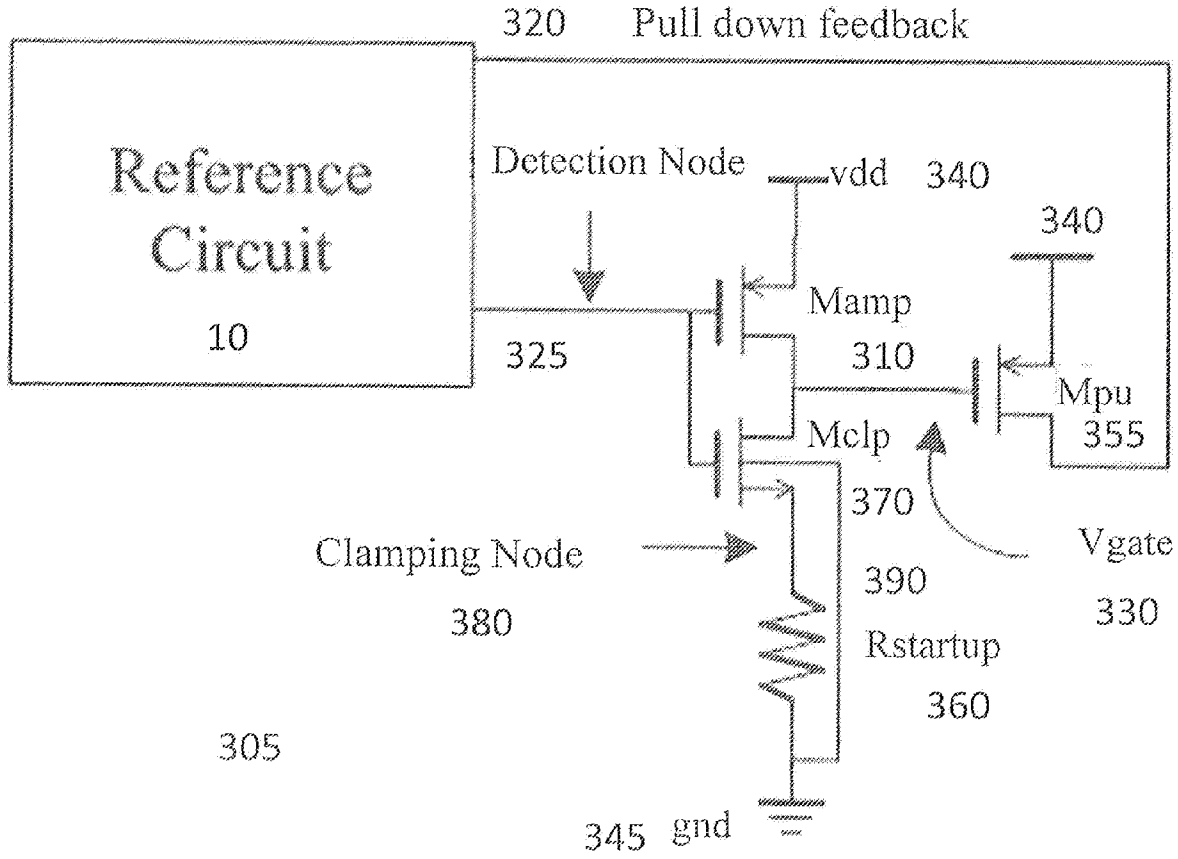
FIG. 3B is a body effect pull up voltage adjusting circuit according to an embodiment of the invention.

FIGS. 3A and 3B illustrate embodiments wherein the clamping transistor also takes advantage of the body effect to improve current consumption. FIG. 3A is a body effect pull down voltage adjusting circuit 300 according to an embodiment of the invention. The voltage adjusting circuit 300 may communicate with a reference circuit 10 at a feedback node 320 and a detection node 325. The circuit 300 may include several transistors, each of which may have a gate and a plurality of current conducting terminals (e.g., a source and drain in the case of a FET or an emitter and collector in the case of a BJT). The pull down voltage adjusting circuit 300 may include a resistive load common source amplifier Mamp 310, for example a transistor with its source connected to ground 345, its drain connected to a node Vgate 330, and its gate connected to the detection node 325. A pull down transistor 350 may have its drain connected to the feedback node 330, its gate connected to V gate 330, and its source connected to ground 345. The voltage adjusting circuit 300 may include a resistor Rstartup 360 and a clamping transistor Mclp 370. The resistor Rstartup 360 may be connected between a voltage source Vdd 340 and a clamping node 380. The source of the clamping transistor Mclp 370 may be connected to the clamping node 380, the gate may be connected to the detection node 325, and the drain may be connected to Vgate 330. A connection 390 may be made between the body of the clamping transistor Mclp 370 and Vdd 340. This connection 390 may apply a bias to the transistor Mclp 370 and thereby increase the threshold voltage (Vth) of Mclp 370. The clamping transistor Mclp 370 may force a voltage at the clamping node 380 (Vclp) to be a sum of a voltage at the detection node 325 (Vdet) and Vth. The amplifier Mamp 310 may drive the pull down transistor 350 to pull the feedback node 320 out of an undesired metastable or unstable operation point when the feedback node 320 is not at the desired voltage. When the detection node 325 of the voltage adjusting circuit 300 achieves a voltage indicating an active operation of voltage adjusting circuit 300, current may flow through the series connected clamping transistor 370 and amplifier 310. The current consumption for this circuit 300 may be (Vdd−Vclp)/Rstartup (i.e., (Vdd−Vdet−Vth)/Rstartup). For example, in a case wherein Vdd is 3V, Vdet is 1.3V, and Vth is 0.8V due to the body effect, a 1 MΩ resistor may be used to provide a desired standby current for the voltage adjusting circuit of 0.9 μA or less. Note that the transistors used in this circuit 300 are not limited to a specific transistor type. For example, the transistors shown are metal oxide semiconductor field effect transistors, but bipolar junction transistors could also be used. Also note that the circuit 300 may be assembled as a package or as part of another system wherein the voltage source and ground are not initially provided. In these cases, external nodes may be provided in place of the voltage source and ground described above, and these external nodes may be configured to be connected to a voltage source and ground.

FIG. 3B is a body effect pull up voltage adjusting circuit 305 according to an embodiment of the invention. The voltage adjusting circuit 305 may communicate with a reference circuit 10 at a feedback node 320 and a detection node 325. The circuit 305 may include several transistors, each of which may have a gate and a plurality of current conducting terminals (e.g., a source and drain in the case of a FET or an emitter and collector in the case of a BJT). The pull up voltage adjusting circuit 305 may include a resistive load common source amplifier Mamp 310, for example a transistor with its source connected to Vdd 340, its drain connected to a node Vgate 330, and its gate connected to the detection node 325. A pull up transistor 355 may have its drain connected to the feedback node 320, its gate connected to Vgate 330, and its source connected to Vdd 340. The voltage adjusting circuit 305 may include a resistor Rstartup 360 and a clamping transistor Mclp 370, The resistor Rstartup 360 may be connected between ground 345 and a clamping node 380. The source of the clamping transistor Mclp 370 may be connected to the clamping node 380, the gate may be connected to the detection node 325, and the drain may be connected to Vgate 330. A connection 390 may be made between the body of the clamping transistor Mclp 370 and Vdd 340. This connection 390 may apply a bias to the transistor Mclp 370 and thereby increase the threshold voltage (Vth) of Mclp 370. The clamping transistor Mclp 370 may force a voltage at the clamping node 380 (Vclp) to be a difference of a voltage at the detection node 325 (Vdet) and Vth. The amplifier Mamp 310 may drive the pull up transistor 355 to pull the feedback node 320 out of an undesired metastable or unstable operation point the feedback node 320 is not at the desired voltage. When the detection node 325 of the voltage adjusting circuit 300 achieves a voltage indicating an active operation of voltage adjusting circuit 300, current may flow through the series connected clamping transistor 370 and amplifier 310. The current consumption for this circuit 305 may be Vclp/Rstartup (Vdet−Vth)/Rstartup). For example, in a case wherein Vdet is 1.7V and Vth is 0.8V due to the body effect, a 1 MΩ resistor may be used to provide a desired standby current for the voltage adjusting circuit of 0.9 μA or less. Note that the transistors used in this circuit 305 are not limited to a specific transistor type. For example, the transistors shown are metal oxide semiconductor field effect transistors, but bipolar junction transistors could also be used. Also note that the circuit 305 may be assembled as a package or as part of another system wherein the voltage source and ground are not initially provided. In these cases, external nodes may be provided in place of the voltage source and ground described above, and these external nodes may be configured to be connected to a voltage source and ground.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments and various uses for the described embodiments. For example, the circuits described herein may be employed as startup circuits. Thus, the present embodiments should not be limited by any of the above-described embodiments In addition, it should be understood that any figures which highlight the functionality and advantages are presented for example purposes only. T he disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

What is claimed is:

1. A circuit comprising:

a detection node and a feedback node adapted to communicate with a reference circuit;

a resistor connected to a clamping node;

a clamping transistor comprising a gate coupled to the detection node, a first current conducting terminal connected to the clamping node and a second current conducting terminal connected to a gate node; and an amplifier transistor comprising current conducting terminals and a gate coupled to the detection node and configured to cause a second voltage to be provided to the feedback node in response to the clamping transistor receiving a first voltage from the detection node, wherein one of the current conducting terminals of the amplifier transistor is connected to the gate node, the clamping node is coupled between the resistor and the clamping transistor, and the clamping transistor is configured to limit a current flowing through the clamping transistor, the amplifier transistor and the resistor which are connected in series with one another, wherein a voltage level at the clamping node is a sum of a voltage of the detection node and a threshold voltage of the clamping transistor or a difference of the voltage of the detection node and the threshold voltage of the clamping transistor, wherein the voltage level is less than a power supply voltage such that the current flowing through the resistor is larger than zero.

2. The circuit of claim 1, further comprising:

a pulling transistor comprising a gate coupled to the gate node and current conducting terminals, wherein one of the current conducting terminals of the pulling transistor is coupled to the feedback node.

3. The circuit of claim 2, wherein:

when the amplifier transistor is driving the pulling transistor and the voltage level at the clamping node is the sum of the voltage of the detection node and the threshold voltage of the clamping transistor, the clamping transistor is configured to cause the voltage at the clamping node to be substantially equal to the sum of the voltage at the detection node and the threshold voltage of the clamping transistor.

4. The circuit of claim 2, wherein:

a source of the amplifier transistor is connected to ground, a drain of the amplifier transistor is connected to the gate node, and a gate of the amplifier transistor is connected to the detection node;

a source of the clamping transistor is connected to the clamping node, a drain of the clamping transistor is connected to the gate node, and a gate of the clamping transistor is connected to the detection node; and a source of the pulling transistor is connected to ground, a drain of the pulling transistor is connected to the feedback node, and a gate of the pulling transistor is connected to the gate node.

5. The circuit of claim 2, wherein:

when the amplifier transistor is driving the pulling transistor and the voltage level at the clamping node is the difference of the voltage of the detection node and the threshold voltage of the clamping transistor, the clamping transistor is configured to cause the voltage at the clamping node to be substantially equal to the voltage at the detection node minus the threshold voltage of the clamping transistor.

6. The circuit of claim 5, wherein:

a source of the amplifier transistor is connected to a voltage source, a drain of the amplifier transistor is connected to the gate node, and a gate of the amplifier transistor is connected to the detection node;

a source of the clamping transistor is connected to the clamping node, a drain of the clamping transistor is connected to the gate node, and a gate of the clamping transistor is connected to the detection node; and a source of the pulling transistor is connected to the voltage source, a drain of the pulling transistor is connected to the feedback node, and a gate of the pulling transistor is connected to the gate node.

7. The circuit of claim 5, wherein the resistor is in communication with ground.

8. The circuit of claim 1, wherein when the detection node produces a voltage indicating active operation, current flows through the current conducting terminals of the clamping transistor and the amplifier transistor.

9. A circuit comprising:

a detection node and a feedback node for communicating with a reference circuit to be applied;

an amplifier element controlled by an input signal from the detection node and having an output;

a load connected to a clamping node;

a clamping element comprising a first current conducting terminal connected to the amplifier element and a second current conducting terminal connected to the clamping node and controlled by the input signal; and a pulling element for providing a pulling voltage to the feedback node in response to the output of the amplifier element, wherein the clamping node is coupled between the load and the clamping element, and the clamping element is configured to limit a current flowing through the clamping element, the amplifier element and the load which are connected in series with one another, wherein a voltage level at the clamping node is a sum of a voltage of the detection node and a threshold voltage of the clamping element or a difference of the voltage of the detection node and the threshold voltage of the clamping element, wherein the voltage level is less than a power supply voltage such that the current flowing through the load is larger than zero.

10. The circuit of claim 9, wherein the amplifier and the clamping elements are two different types of transistors while the amplifier and the pulling elements are the same types of transistor.

11. The circuit of claim 10, wherein the body effect of the clamping element is enhanced by a bias from one of the power supply voltage and a voltage at a source terminal of the clamping element.

12. The circuit of claim 9, wherein the load is adapted to be connected to the power supply voltage.

13. The circuit of claim 9, wherein the load is adapted to be connected to ground.

* * * * *